United States Patent [19]

Schwob et al.

[11] Patent Number: 4,618,746

[45] Date of Patent: Oct. 21, 1986

[54] BALL ACTUATED POSITION SENSITIVE SWITCH

[75] Inventors: Pierre Schwob, Lyons; Marcel Dimey, Grandfontaine, both of France

[73] Assignee: SEB S.A., Selongey, France

[21] Appl. No.: 741,292

[22] Filed: Jun. 4, 1985

[30] Foreign Application Priority Data

Jun. 5, 1984 [FR] France ..... 84 08775

[51] Int. Cl.[4] ..... H01H 35/14

[52] U.S. Cl. ..... 200/61.45 R; 200/61.52; 200/DIG. 29

[58] Field of Search ..... 200/61.45 R, 61.45 M, 200/61.5, 61.52, DIG. 29

[56] References Cited

U.S. PATENT DOCUMENTS

| | | | |
|---|---|---|---|
| 2,428,029 | 9/1947 | Katcher | 200/61.45 R X |
| 2,879,349 | 3/1959 | Thompson | 200/61.52 X |
| 3,816,680 | 6/1974 | Suzuki et al. | 200/61.52 X |
| 4,178,492 | 12/1979 | Roesch et al. | 200/61.45 R |
| 4,185,507 | 1/1980 | Domyan | 200/61.45 R X |
| 4,255,629 | 3/1981 | Bell | 200/61.45 R |

FOREIGN PATENT DOCUMENTS

| | | |
|---|---|---|
| 438342 | 2/1926 | Fed. Rep. of Germany . |
| 1287675 | 1/1969 | Fed. Rep. of Germany . |
| 1548060 | 11/1968 | France . |

*Primary Examiner*—J. R. Scott

*Attorney, Agent, or Firm*—Young & Thompson

[57] ABSTRACT

The multi-directional switch according to the invention possesses a housing (1), in which at least two electrical contacts (2, 3) are arranged opposite one another, a tilting member (5) being supported in the housing (1) by means of a tilting part (6) and having a control part (7) extending in the vicinity of one of the electrical contacts, the ball being carried by a surface (9) of the tilting member (5) opposite the tilting part (6) and having a profile in the form of a cup.

11 Claims, 5 Drawing Figures

FIG_3
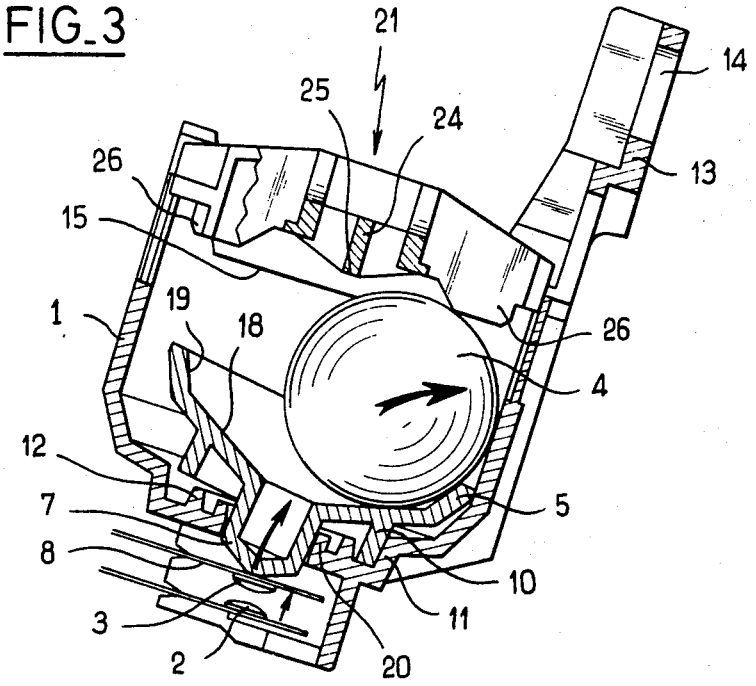
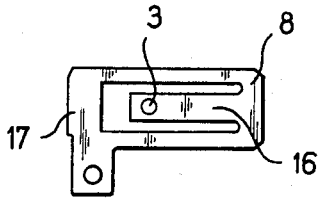
FIG_4
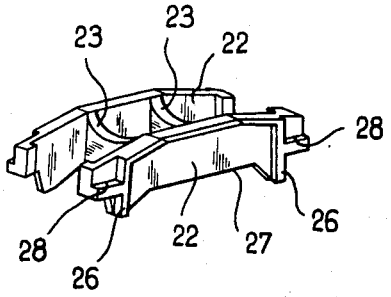
FIG_5

BALL ACTUATED POSITION SENSITIVE SWITCH

The present invention relates to a multidirectional switch which can be used particularly as a safety switch in a heating device, such as an electric radiator.

BACKGROUND OF THE INVENTION

It has often been observed that certain appliances, particularly household appliances, must incorporate a safety switch sensitive to a shock exerted on the appliance or to an inclination of the latter, so as to cut off the supply to the appliance. In particular, where a portable electric radiator is concerned, there is a considerable risk of fire if the electric radiator is tipped against inflammable articles or placed on a surface which is not flat, so that the heating element is located near an inflammable article.

Safety switches known hitherto usually comprise a pendulum associated with electrical contacts arranged in the supply circuit, to make a connection between these contacts when the appliance is in the normal position of use, and to break the supply circuit when the appliance experiences a shock beyond a predetermined threshold or is inclined beyond a predetermined threshold according to the characteristics of the appliance.

It is also known to produce safety switches incorporating a sensitive element in the form of a ball normally arranged above a switch of the push-button type for closing the electrical supply circuit in the normal position of the appliance. When the appliance experiences a shock or is inclined, the ball escapes and releases the push-button which opens the electrical supply circuit. This type of safety switch has a cost price less than that of safety switches incorporating a pendulum, since the cost price of the ball is usually substantially below the cost price of a pendulum. However, the disadvantage of these switches is that they cannot be reset. In fact, when the push-button has come out and the appliance has been returned to its normal position, the ball comes up against the side of the push-button and therefore cannot act on the latter to reclose the switch. The switch consequently has to be reset manually, and this presents problems for users who are not familiar with the technique.

SUMMARY OF THE INVENTION

An aim of the present invention is to propose a multidirectional switch which has a low cost price, but which can nevertheless be reset automatically when the appliance on which the switch is fitted is subject to normal operating conditions.

To achieve this aim, there is provided, according to the invention, a multi-directional switch possessing a housing, in which are arranged at least two electrical contacts opposite one another and a control ball closing an electrical circuit between the contacts, this switch being characterised in that it incorporates a tilting member which is supported in the housing by means of a tilting part and which possesses a control part extending in the vicinity of at least one of the electrical contacts, and in that the ball is carried by a surface of the tilting member opposite the tilting part and having a profile in the form of a cup.

Thus, when the switch, or the appliance on which the switch is fitted, is in the position of rest, the tilting member is in the first position and the control part acts in a corresponding way on the electrical circuit. When the switch, or the appliance on which the switch is fitted, is subjected to a shock or is inclined, the ball moves away from its position of rest in the cup and causes a tilting of the tilting member, together with a corresponding displacement of the control part. Because of the cup-shape profile of the surface on which the ball rests, the latter returns to its position of rest automatically when the normal conditions of use are restored.

According to an advantageous version of the invention, the tilting part is a shoulder having at least one sharp edge set back relative to the edge of the surface of the tilting member carrying the ball.

Thus, the sharp edge of the shoulder acts in the same way as the knife of a balance, thus producing a sudden tilting of the tilting member, resulting in a clean closing or opening of the electrical circuit.

According to a preferred version of the invention, the shoulder interacts with a stop surface carried by the housing, and more particularly the tilting member rests in the bottom of the housing and comprises a rigid skirt, one edge of which forms the tilting part, the rigid skirt being retained on one side by the lateral wall of the housing and on the other side by a rib provided in the bottom of the housing. This prevents the tilting member from sliding on the bottom of the housing when the tilting member tilts.

According to another preferred feature of the invention, the cup-shaped surface is frustoconical, and the tilting part is a circular edge coaxial relative to the frustoconical surface. Thus, the tilting threshold of the tilting member is the same, whatever the direction in which the switch or tha appliance supporting it its tilted.

According to yet another feature of the invention, the switch incorporates a cover, the inner surface of which has a profile, on which the control ball bears without jamming, when the switch is inclined. Thus, the ball cannot escape from the housing when the switch is inclined and always performs its function of automatic return when the switch is brought back into the normal position.

BRIEF DESCRIPTION OF THE DRAWINGS

Other characteristics and advantages of the invention will also emerge from the following description of a non-limiting example, with reference to the attached drawings in which:

FIG. 3 is a sectional view in the plane III—III of FIG. 2, FIG. 4 is a plan view of a support for an electrical contact, FIG. 5 is a perspective view of the cover.

DETAILED DESCRIPTION OF THE DRAWINGS

Figure 1:
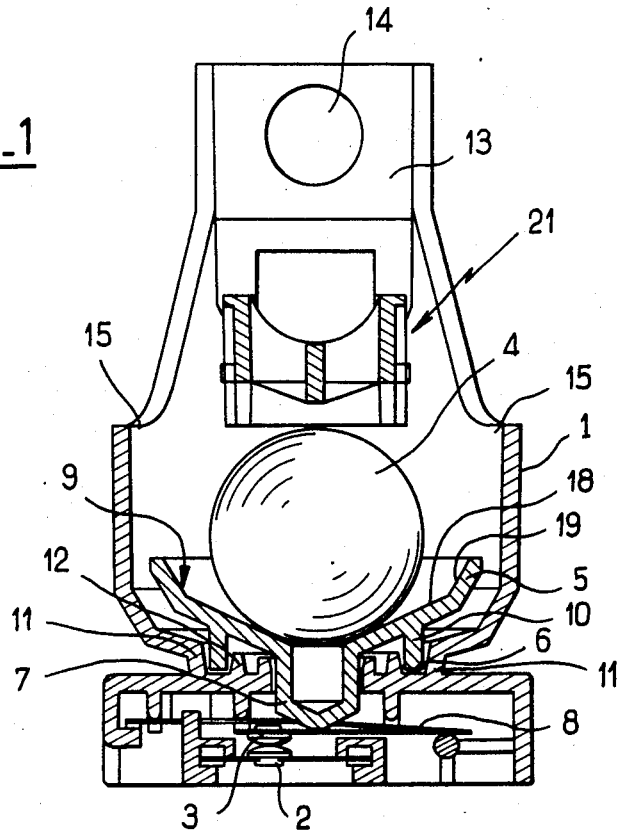
FIG. 1 is a sectional view in the plane I—I of FIG. 2, in the position of rest of the switch.

With reference to the figures, the multi-directional switch possesses a generally cylindrical housing 1, in which are arranged two electrical contacts 2 and 3 opposite one another and a control ball 4 serving to close an electrical circuit between the electrical contacts 2, 3.

According to the invention, the switch incorporates a tilting member 5 which is supported in the housing 1 by means of a tilting edge 6 and which possesses a control finger 7 extending in the vicinity of the support plate 8 for the electrical contact 3, the ball 4 being carried by a surface 9 of the tilting member 5 opposite the tilting edge 6 and having a profile in the form of a cup.

The tilting edge is carried by a shoulder of the tilting member, set back relative to the edge of the surface 9 of the tilting member 5 carrying the ball 4. In the embodiment illustrated, the tilting 6 is formed by the lower edge of a rigid skirt 10 extending downwards from the lower face of the tilting member 5.

In its lower part, the housing 1 has a narrowed edge 11 forming a stop surface from the tilting part 6. More particularly, the rigid skirt 10, one edge 6 of which forms the tilting part, rests in the bottom of the housing 1 and is retained on one side by the lateral wall forming the narrowed part 11 of the housing 1 and on the other side by a circular rib 12 provided in the bottom of the housing 1.

In its upper part, the housing 1 has a shank 13 perforated with an orifice 14 serving to fasten the multidirectional switch in the appliance the safety of which it is intended to ensure. The housing 1 also possesses widely scalloped upper edges 15 allowing easy access to the interior of the housing.

The contact 3 is carried by a rectangular supporting plate 8 having a central tongue 16 (FIG. 4) carrying the contact 3. The end of the plate 8, to which the tongue 16 is connected, is movable, whilst the end 17 of the plate 8 opposite that to which the tongue 16 is connected is retained in the housing. This makes it possible to achieve a substantial elastic displacement travel for the contact 3, whilst at the same time maintaining reduced dimensions for the support plate 8.

The cup-shaped surface 9 is preferably frustoconical and the tilting edge 6 extends round the axis of the cup, so that the tilting member 5 can tilt in any direction. In particular, where a circular rigid skirt 10 is concerned, the tilting part consisting of the edge 6, of this skirt is a circular edge coaxial relative to the frustoconical surface 9.

In the embodiment illustrated, the cup-shaped surface 9 comprises a central part 18 having a first inclination and a peripheral part 19 having an inclination greater than the central part 18, so that when the ball 4 reaches the peripheral part 19 the tilting torque exerted on the tilting member 5 is increased.

The control finger 7 is coaxial relative to the cup-shaped surface 9 and to the tilting edge 6 and extends through the bottom of the housing 1. To prevent the finger 7 from escaping from the orifice, in which it is inserted, during the tilting of the tilting member 5, there is advantageously provided a rib 20 surrounding the orifice in which the finger 7 extends. Although the ribs 12 and 20 have been represented as being separate for manufacturing reasons, it will be understood that these two ribs can be combined in one and the same annular strip surrounding the central orifice in the bottom of the housing.

Figure 2:
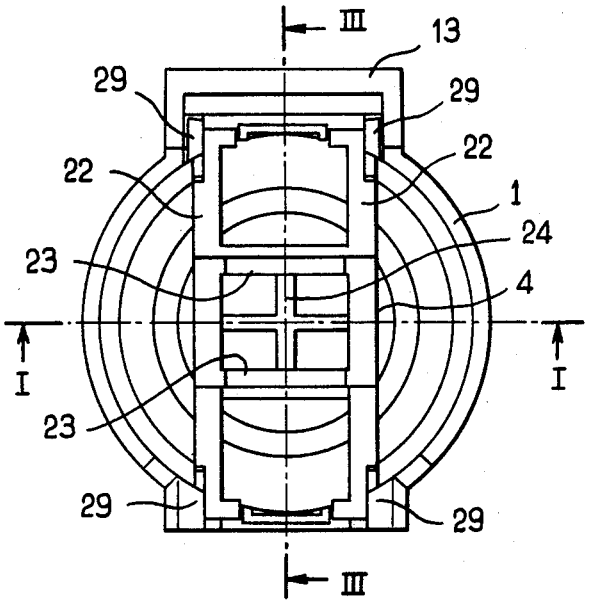
FIG. 2 is a plan view of the switch in the position of rest.

To prevent the ball 4 from escaping when the switch is returned, there is provided a bar-shaped cover 21, the inner surface of which has a profile, on which the ball 4 bears without jamming, when the switch is inclined. In particular, the bar is formed by two lateral walls 22 (see FIGS. 2 and 5) joined to one another by means of intermediate walls 23 supporting a crosspiece 24, the central part of which extends downwards to form a tip 25 (FIG. 3). The walls 22 also possess at their ends parts 26 which project downwards relative to the middle edges 27. Thus, the face of the bar turned towards the ball 4 has a zigzag-shaped profile (see FIG. 3).

The cover 21 is preferably retained in orifices in the lateral wall of the housing 1 and has shoulders 28 which interact with flexible tongues in the form of hooks 29 (FIG. 2) made in one piece with the lateral wall of the housing 1.

When the switch is in the normal operating position, the tilting member 5 rests on the bottom of the housing 1 and the finger 7 extends through the bottom to press on the support plate 8 and keep the contact 3 pressed against the contact 2. The electrical circuit is then closed. When the switch experiences a shock or is inclined, the ball 4 rolls along the surface 9 supporting it and, at the moment when the torque generated by the ball 4 about the tilting part 6, added to the torque resulting from the elastic force of the support plate 8, compensates the torque resulting from the weight of the tilting member 5 exerted at its centre of gravity, the tilting member 5 tilts suddenly and the contact 3 separates from the contact 2, thus opening the electrical circuit.

As soon as the cause of the movement of the ball 4 towards the edge of the surface 9 has disappeared, and because of the cup shape of this surface, the ball returns towards its position of rest and the electrical circuit is closed again automatically.

Of course, the invention is not limited to the embodiment described above, and it can be given alternative forms. In particular, the lower end of the control finger 7 can be conductive, and the contacts 2 and 3 can be arranged opposite one another on either side of the finger end 7, so that the two contacts are joined together by the conductive finger of the control part when the finger 7 is in the position of rest.

The tilting member can have small dimensions and be arranged at the centre of a housing possessing an inclined wall extending the cup shape of the tilting member.

The tilting member can have a shape other than circular, for example with a rectangular surface which is retained on the sides and which can tilt in one or more given directions only.

Instead of being located in the lower part of the tilting member 5, the control member 7 can be arranged on the side of the tilting member, for example extending from one of its edges.

The surface 9 of the tilting member can be offset relative to the tilting edge 6, to produce a preferred tilting direction.

We claim:

1. A multi-directional switch comprising:

a housing comprising two electrical contacts, one of said contacts being movable between a closed position and an open position;

an actuating member movably disposed in the housing and having a control portion engaging the movable contact and a cup-shaped recess opening away from the contacts;

mutually engageable first and second fulcrum means provided respectively on the actuating member and in the housing, radially between a deepest area of the cup-shaped recess and an outer edge of the cup-shaped recess;

a ball movable in the housing;

the housing being internally shaped so as to limit movement of the actuating member and of the ball, and maintain the ball in the cup-shaped recess, and the first and second fulcrum means in a mutually facing relationship;

wherein the control portion controls displacement of the movable contact into one of its positions when the actuating member is in a seated position in which the first and second fulcrum means are mutually engaged all around the deepest area, whereas the control portion controls displacement of the movable contact into its other of said closed and open positions when the actuating member is in a tilted-away position with the first and second fulcrum means being at least partly lifted from one another.

2. A multi-directional switch according to claim 1, wherein the first and second fulcrum means surround the control portion.

3. A multi-directional switch according to claim 1, wherein the first fulcrum means comprise an annular skirt projecting in a direction opposite the direction in which the cup-shaped recess faces.

4. A multi-directional switch according to claim 1, wherein the first fulcrum means project from the actuating member and the second fulcrum means comprise an annular groove receiving the projecting first fulcrum means.

5. A multi-directional switch according to claim 1, wherein the control portion extends along an axis of the actuating member, the first and second fulcrum means are provided along a circle centered on said axis, around the control portion, and the cup-shaped recess has a symmetry of revolution about said axis.

6. A multi-directional switch according to claim 1, wherein the cup-shaped recess comprises a central area (18) having a first slope and a peripheral area having a slope greater than the first slope.

7. A multi-directional switch according to claim 1, wherein the control portion is a finger extending towards the contacts through an aperture of the housing, the housing carrying the second fulcrum means around said aperture and the actuating member carrying the first fulcrum means around said finger.

8. A multi-directional switch according to claim 1, wherein the housing comprises, opposite the cup-shaped recess, a cover having inwardly projecting cam means opposite a peripheral area of the cup-shaped recess, said cam means maintaining the ball in a position for maintaining the actuating member in said tilted-away position.

9. A switch comprising:

a housing having two electrical contacts, one of said contacts being movable between a closed position and an open position;

a tilter member having an inclined surface and a control portion; and a ball adapted to bear against said inclined surface of said tilter member and movable along a path on said inclined surface, said surface facing away from the contacts and said path overriding a position where the tilter member is tiltingly supported in said housing between a first position in which a control portion of said tilter member controls displacement of the movable contact into one of its positions, and a second position in which the control portion controls displacement of the movable contact into its other of said closed and open positions;

means for maintaining the ball captive adjacent the inclined surface.

10. A switch according to claim 9, wherein the inclined surface has, adjacent a first end, which is an upper end when the switch is level, a first slope which is greater than a second slope of the inclined surface at an end remote from the first end.

11. A switch according to claim 9, wherein the housing comprises, opposite the inclined surface, a cover having inwardly projecting cam means opposite at least one end of the path along the inclined surface, said cam means maintaining the ball in a position in which a portion of the inclined surface adjacent said end of the path is depressed when the ball is adjacent said portion of the inclined surface.

* * * * *